US007608804B2

(12) United States Patent
Tanaka

(10) Patent No.: US 7,608,804 B2
(45) Date of Patent: Oct. 27, 2009

(54) TILTING HEATING APPARATUS AND ON-THE-SPOT HEAT TREATMENT SYSTEM FOR HEATING OBJECT

(75) Inventor: Shigehiro Tanaka, Kyoto (JP)

(73) Assignee: Astencook Corporation, Kyoto (JP)

( * ) Notice: Subject to any disclaimer, the term of this patent is extended or adjusted under 35 U.S.C. 154(b) by 764 days.

(21) Appl. No.: 10/572,297

(22) PCT Filed: Sep. 17, 2003

(86) PCT No.: PCT/JP03/11826

§ 371 (c)(1),
(2), (4) Date: Mar. 14, 2006

(87) PCT Pub. No.: WO2005/028754

PCT Pub. Date: Mar. 31, 2005

(65) Prior Publication Data

US 2007/0092848 A1 Apr. 26, 2007

(51) Int. Cl.
*H05B 3/68* (2006.01)
*F27B 7/00* (2006.01)
*B28C 7/16* (2006.01)

(52) U.S. Cl. ..... 219/448.11; 432/103; 366/45

(58) Field of Classification Search ..... 219/428–442, 219/448.11; 432/103–105, 118; 366/45, 366/53, 54, 60, 61
See application file for complete search history.

(56) References Cited

U.S. PATENT DOCUMENTS 4,208,135 A * 6/1980 Bastiao ..... 366/219
4,268,174 A 5/1981 Falardeau
4,441,820 A * 4/1984 Maxon, III ..... 366/26
4,758,268 A 7/1988 Bishop et al.
4,951,260 A * 8/1990 Strehlow ..... 366/45
6,213,763 B1 * 4/2001 Slade et al. ..... 432/103

FOREIGN PATENT DOCUMENTS

| | | |
|---|---|---|
| JP | 64-53207 | 4/1989 |
| JP | 04-263051 | 9/1992 |
| JP | 07-102517 | 4/1995 |
| JP | 08-11025 | 4/1996 |
| JP | 11-141837 | 5/1999 |
| JP | 11-269812 | 10/1999 |
| JP | 2001-342608 | 12/2001 |

* cited by examiner

*Primary Examiner*—Sang Y Paik
(74) *Attorney, Agent, or Firm*—Duane Morris LLP

(57) ABSTRACT

The present invention relates to a tilting heating apparatus in which a heating container is not lowered below the level of a tilting base when the heating container is tilted with its opening faced upward and an on-the-spot heat treatment system for a heating object. The present invention comprises a tilting base which is placed on a fixed portion and pivotal upward, an oscillating support supported by the tilting base and capable of pivotal movement, a heating apparatus consisting of a heating container attached onto the oscillating support and having a bottom with an opening and a pivotal driving mechanism for turning the heating container, a first derricking cylinder provided between the fixed portion side and the tilting base side for expansion/contraction and for displacing the tilting base to an substantially horizontal position and a rearward tilting position where the opening of the heating container is displaced upward, and a second derricking cylinder provided between the tilting base side and the oscillating support side for expansion/contraction and for displacing the oscillating support to a stationary position on the tilting base and in a forward tilting direction.

20 Claims, 7 Drawing Sheets

TILTING HEATING APPARATUS AND ON-THE-SPOT HEAT TREATMENT SYSTEM FOR HEATING OBJECT

TECHNICAL FIELD

The present invention relates to a tilting heating apparatus which heats/dissolves a heating object on the spot and can be mounted in a vehicle such as a truck, and an on-the-spot heat treatment system for a heating object.

BACKGROUND ART

As a tilting heating apparatus and on-the-spot heat treatment system for a heating object, a technology is known that an asphalt piece peeled from a drilled road surface is heated and recycled or asphalt is newly generated to repair a paved surface on the spot of repair work for underground installation of a paved road surface.

In this type of tilting heating apparatus, a heating container is tilted upward at input or heating of asphalt pieces into the heating container, while it is tilted downward at discharge.

However, the conventional tilting heating apparatus has problems that a supporting point for tilting of the heating container is constant, and when the size of the heating container is increased, the tilting angle is limited, which makes input or discharge of asphalt pieces difficult. And if a sufficient angular motion is to be performed, the position of the supporting point becomes high and the center of gravity of the vehicle is raised, which is unstable.

Then, the applicant has already proposed a structure provided with an oscillating support supporting a heating container and a driving mechanism of the heating container capable of tilting, a tilting base rotatably supporting the oscillating support, and tilting means such as a hydraulic cylinder for rotationally moving the oscillating support so that an opening of the heating container is faced upward/downward as a tilting heating apparatus in the Japanese Patent Laid-open No. 8-110025.

In this tilting heating apparatus, since the oscillating support is vertically tilted by a cylinder, a stroke of a fixed cylinder becomes longer, and since the oscillating support might be displaced downward from the tilting base when the heating container is tilted rearward, work can not be done in the state placed on a bed of a vehicle.

The present invention was made in view of the above circumstances, and its main object is to provide a tilting heating apparatus which can largely tilt forward and rearward even if the size of a heating container is increased and an on-the-spot heat treatment system for a heating object using this.

DISCLOSURE OF THE INVENTION

A tilting heating apparatus according to the present invention is provided with a tilting base which is placed on a fixed portion and pivotal upward, an oscillating support supported by the tilting base and capable of pivotal movement, a heating apparatus consisting of a heating container attached onto the oscillating support and having a bottom with an opening and a pivotal driving mechanism for turning the heating container, first derricking cylinders provided between the fixed portion side and the tilting base side for expansion/contraction and for displacing the tilting base to an substantially horizontal position and a rearward tilting position where the opening of the heating container is displaced upward, and second derricking cylinders provided between the tilting base side and the oscillating support side for expansion/contraction and for displacing the oscillating support to a stationary position on the tilting base and in a forward tilting direction.

On the tilting base, a middle position of the oscillating support is pivotally attached and the first derricking cylinders which derrick the tilting base are pivotally attached between the tilting base side and the fixed portion.

Also, the first derricking cylinders may be made into an outrigger structure, or such a structure may be adopted that an outrigger is provided separately from the first derricking cylinders and fixed to the ground in use.

Technical means are adopted that the tilting base and the middle position of the oscillating support are pivotally attached through their brackets and a rear end of the oscillating support is obliquely in contact with the tilting base and the rear end of the oscillating support is formed into an inclined surface so as to stand still without a gap between itself and the tilting base.

Also, the tilting heating apparatus of the present invention is so constituted that, the oscillating support is made of a box-like frame, and a middle position of an operating lever is pivotally attached to the front side (in the rear of the vehicle) of an upper frame of the box-like frame, and the tip end of the operating lever is pivotally attached to an operating plate overlapping in front of the front frame suspended at the front end of the upper frame and having an upper portion pivotally attached. And an upper end of a burner holding plate on which a burner attachment base is provided is pivotally attached to the lower end of the operating plate, and the base end of the operating lever is connected to lever tilting means. The operating lever is swiveled by the lever tilting means with the pivotal attachment position relative to the upper frame of the frame as a supporting point, the operating plate is caused to be substantially orthogonal to the upper frame of the box-like frame, and the burner holding plate is displaced between a full open position at which it is moved up to the upper end of the front frame and a closing position at which the operating plate and the burner holding plate close the front side (in the rear of the vehicle) of the front frame in parallel with the front frame.

The above heating apparatus may be provided on a bed of a vehicle.

Also, the on-the-spot heat treatment system for a heating object of the present invention is, in a system for heat treatment of a heating object such as asphalt or a paving waste material to be offered for use, a tilting heating apparatus is so constituted that a fixed portion is provided at a predetermined position, a tilting base is formed on the fixed portion capable of tilting, an oscillating support pivotally holding a heating container with a bottom having an opening is pivotally attached onto the tilting base, the tilting base and the oscillating support are pivotally moved individually or at the same time so that the attitude of the heating container or the position of the opening is inclined and displaced in a desired direction so that input, heating, heat retention or discharge of the heating object can be carried out individually.

Figure 1:
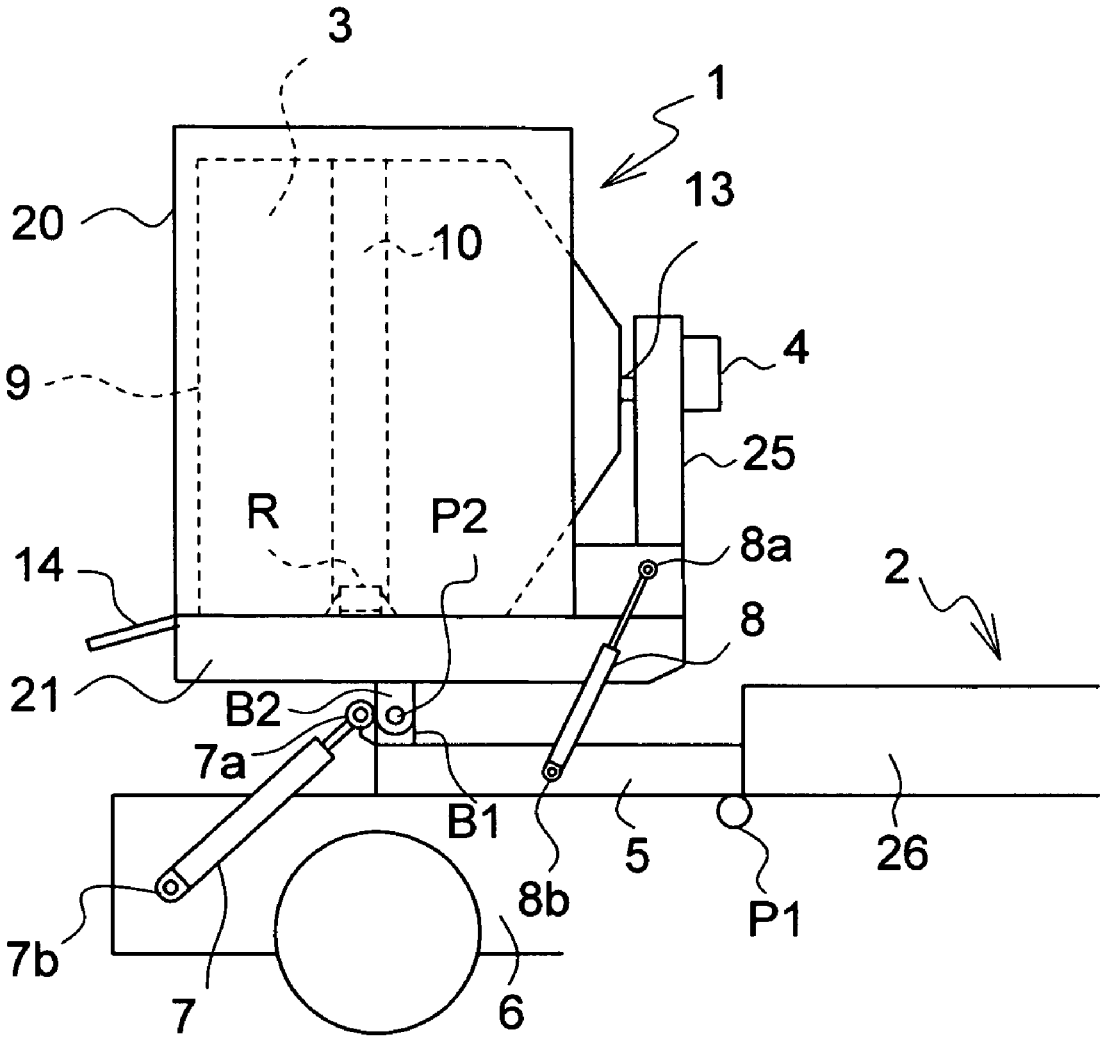
FIG. 1 is a side sectional view showing a standby state of a tilting heating apparatus.

A preferred embodiment when the tilting heating apparatus of the present invention is applied to an in-vehicle asphalt regenerating apparatus will be described below referring to attached drawings.

This tilting heating apparatus 1 is an in-vehicle type which is mounted in a back side part at a position corresponding to a bed of a vehicle 2 such as a truck as shown in FIGS. 1 to 4.

That is, in the tilting heating apparatus 1, a pivotal tilting base 5 is pivotally attached on a flat fixed portion 6 such as a base frame or a chassis for a bed of the vehicle 2 in this preferred embodiment.

That is, a pivot shaft P1 is fixed on a front end bottom portion of the tilting base 5 and pivotally attached to the fixed portion 6 in the illustrated example.

It is to be noted that the tilting heating apparatus 1 is arranged in the back side part at a position corresponding to the bed, and a side plate 26 is provided in the front side part so as to function as a storage space.

A pair of right and left upward brackets B1 are provided on the rear end side of this tilting base 5.

On the other hand, a box-like oscillating support 20 having an opened rear surface is mounted and pivotally attached on this tilting base 5.

A pair of right and left downward brackets B2 are provided at a middle position of a bottom portion 21 of this oscillating support 20, matched with the opposed brackets B1 of the tilting base 5 and respectively pivotally attached by a pivot shaft P2.

The tilting heating apparatus is fixed to this oscillating support 20 so as to face the back side, and both right and left sides thereof are covered with a panel, thereby providing a box-like shape.

That is, a pot-like heating container 3 with a bottom having an opening portion is supported on the bottom portion 21 so as to be capable of swiveling, and a swiveling drive mechanism such as a drive motor 4 which swivels the heating container 3 is fixed to an auxiliary frame 25 provided on the bottom portion 21.

Here, the heating container 3 has an opening portion 9 at an upper portion thereof, is formed into a drum shape in which an intermediate barrel portion is expanded and a bottom portion is closed, and arranged in such a manner that the opening portion 9 substantially horizontally faces the rear side of the vehicle 2 (See FIG. 1).

Furthermore, a rotary shaft 13 is fixed to the bottom portion of the heating container 3, and rotation of the drive motor 4 swivels the heating container 3.

For this purpose, an annular belt 10 is fixed along an outer circumferential wall surface of the intermediate barrel portion of the heating container 3, a roller R provided on the bottom portion 21 rolls on the belt 10, and the heating container 3 is supported so as to be capable of swiveling around the rotary shaft 13 in an outer circumferential direction.

The heating object put into the heating container 3 is an asphalt piece for recycle in this embodiment, but the heating object is not restricted to the foregoing embodiment in the present invention, and it may be a new asphalt raw material, an industrial waste or any other appropriate material.

Moreover, in case of the illustrated example, the oscillating support 20 takes an attitude inclined with respect to the tilting base 5 based on heights of the brackets B1 and B2 provided at pivotal attachment positions.

Figure 2:
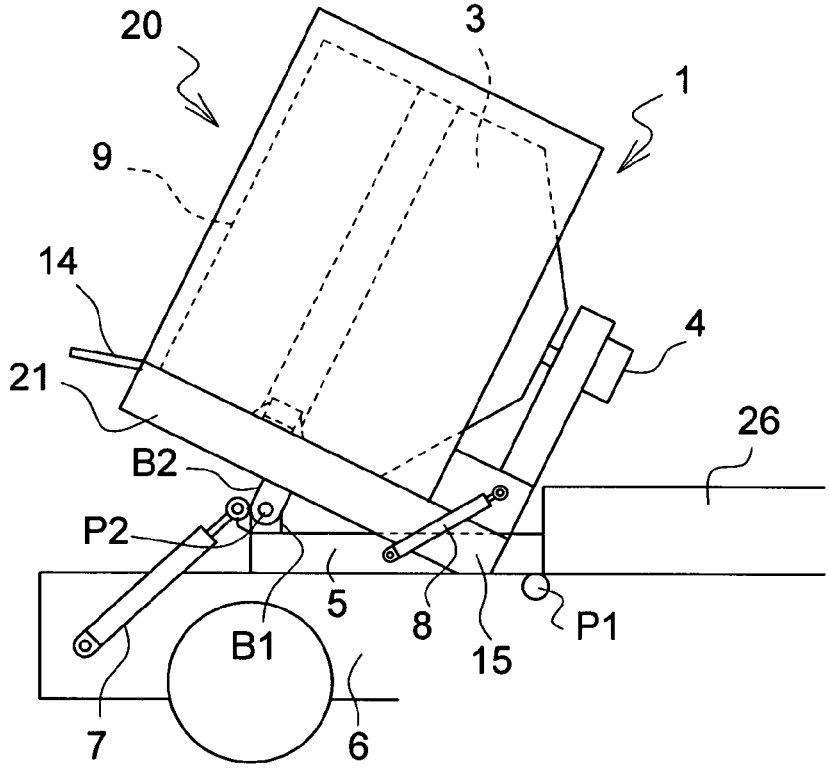
FIG. 2 is a side sectional view showing a standard state of the tilting heating apparatus.
Figure 3:
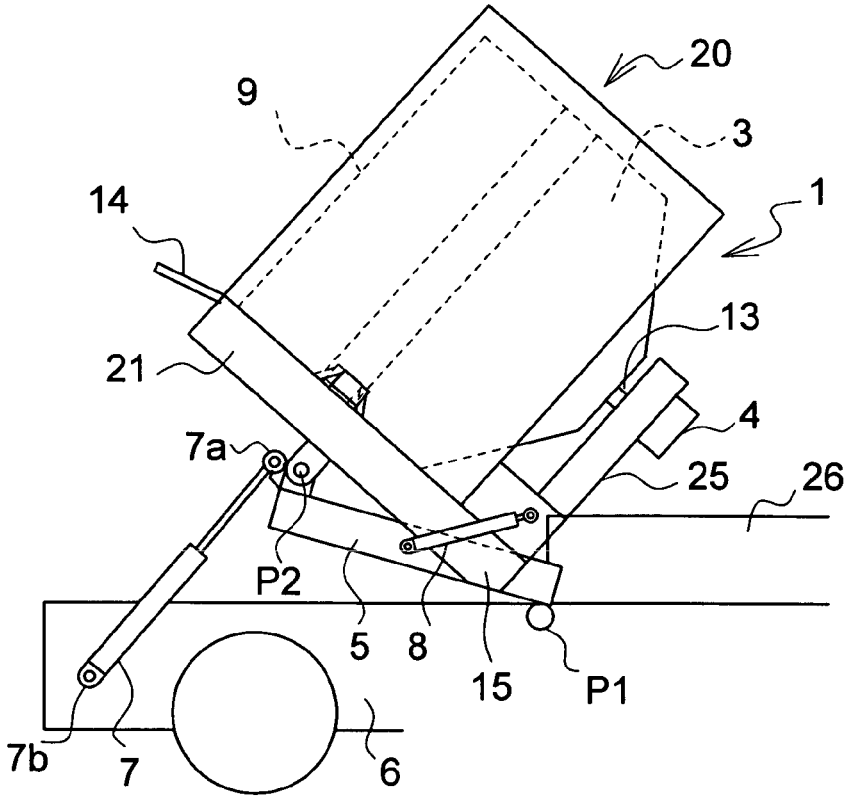
FIG. 3 is a side sectional view showing an uppermost position state of the tilting heating apparatus.

Thus, a front lower portion (in the front of the vehicle) of the bottom portion 21 is formed into a socket portion 15 having a channel-like cross section, and it is fitted on the tilting base 5, thereby increasing the stability (See FIGS. 2 and 3).

Additionally, in this embodiment, a protrusion portion is provided to each of the pair of right and left brackets B1 of the tilting base 5, and an expandable end 7*a* of a first derricking cylinder 7 is pivotally attached to each of them.

A fixed end 7*b* of each of the pair of right and left first derricking cylinders 7 is pivotally attached to a fixed portion 6 such as chassis in the illustrated example.

Therefore, since the tilting base 5 is inclined in the clockwise direction in the drawing by expanding the first derricking cylinders 7 and the oscillating support 20 mounted on the tilting base 5 is also inclined, the built-in heating container 3 can upwardly displace its opening portion 9 as shown in FIG. 3.

An outrigger 7' may be used for the first derricking cylinder 7 in order to increase a derricking force.

Figure 5:
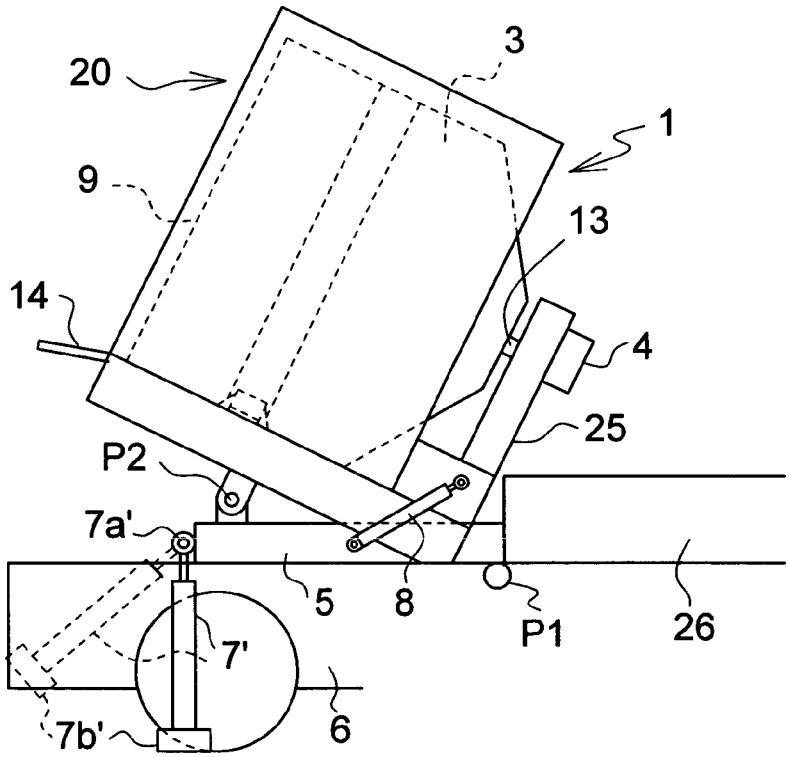
FIG. 5 is a side sectional view of the tilting heating apparatus of another preferred embodiment in which a first derricking cylinder is made of an outrigger.

That is, in FIG. 5, the outrigger 7' is used in place of the first derricking cylinder, an expandable end 7*a*' at the tip end is pivotally attached at a rear end of the tilting base 5, and a fixed end 7*b*' at a base end is detachably hooked on the chassis 6 side of the vehicle 2.

Therefore, when using the outrigger first derricking cylinder 7', displacement occurs from a position indicated by dotted lines in the drawing to a vertical use position indicated by solid lines, and the fixed end 7*b*' is installed on the ground.

Further, the outrigger 7' can expand the cylinder and tilt the tilting base 5 upwards as shown in FIG. 3.

In the present invention, a similar supporting structure may be adopted (not shown) by providing the outrigger separately from the first derricking cylinder 7 in place of the above described structure.

Any other structures are the same as those in the above preferred embodiment, and the explanation will be omitted.

Next, between the tilting base 5 and the oscillating support 20, a pair of right and left second derricking cylinders 8 are provided capable of expansion/contraction for displacing the oscillating support 20 to the position loaded on the tilting base 5 and the forward tilting position.

Figure 4:
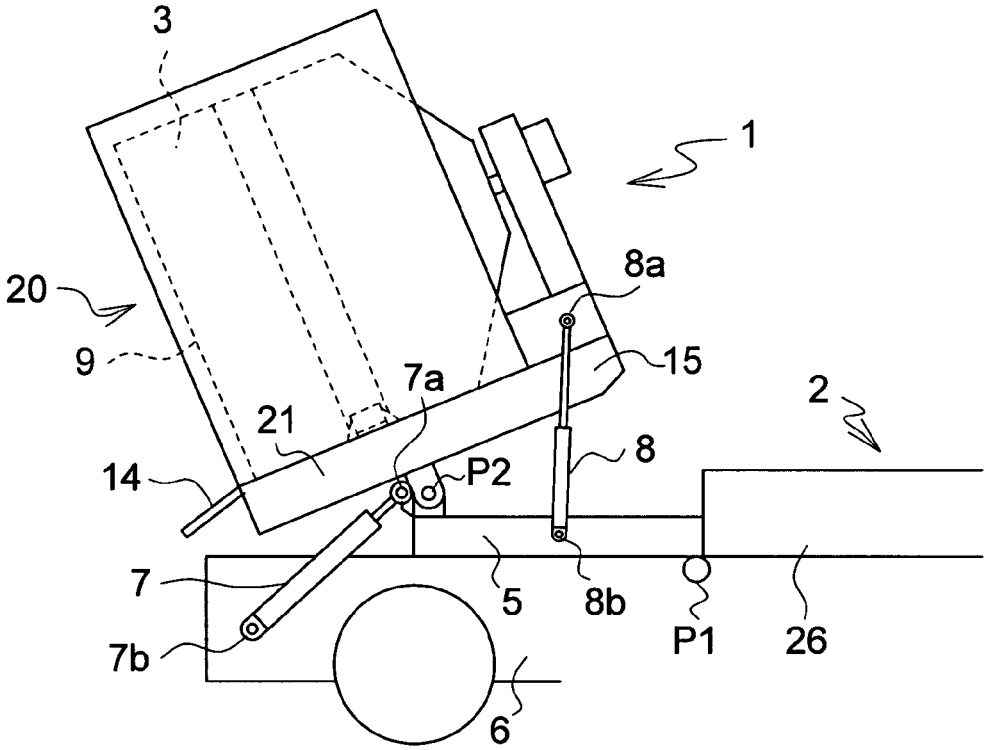
FIG. 4 is a side sectional view showing a discharge state of the tilting heating apparatus.

And when the second derricking cylinders 8 are contracted, as shown in FIGS. 2 and 3, the oscillating support 20 is hooked on the tilting base 5, while when the second derricking cylinders 8 are extended, as shown in FIG. 4, the oscillating support 20 is tilted backward with respect to the tilting base 5 so that an opening portion 9 of the heating container 3 can be displaced downward.

Next, the above drive motor 4 is made of a hydraulic motor in this preferred embodiment and is connected to a rotary shaft 13 protruding at a bottom portion of the heating container 3 through a transmission mechanism (not shown).

In this preferred embodiment, the drive motor 4 and the first and the second derricking cylinders 7 and 8 are connected to the hydraulic pump (not shown) mounted on the vehicle 2 and are operated by an operation portion (not shown) provided at an appropriate position such as a driver seat on the vehicle 2.

Next, the oscillating support 20 has an opened rear surface so that input/discharge of a heating object to/from the opening portion 9 of the built-in heating container 3 is made possible.

Figure 6:
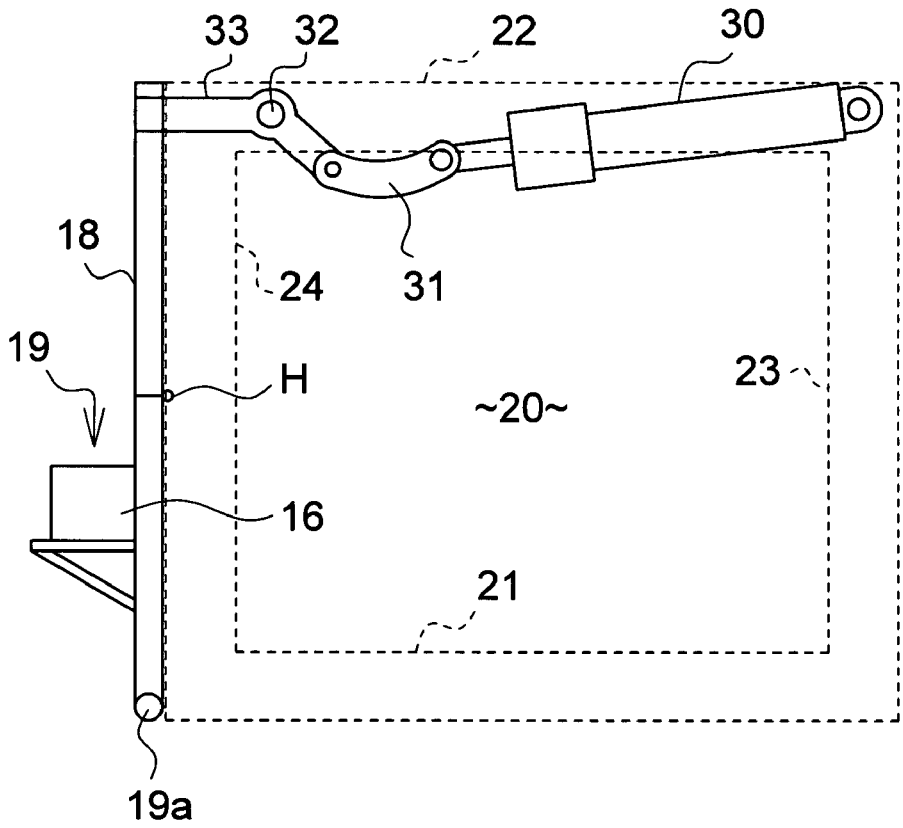
FIG. 6 is an explanatory view of a state where the opening of an oscillating support is closed.
Figure 7:
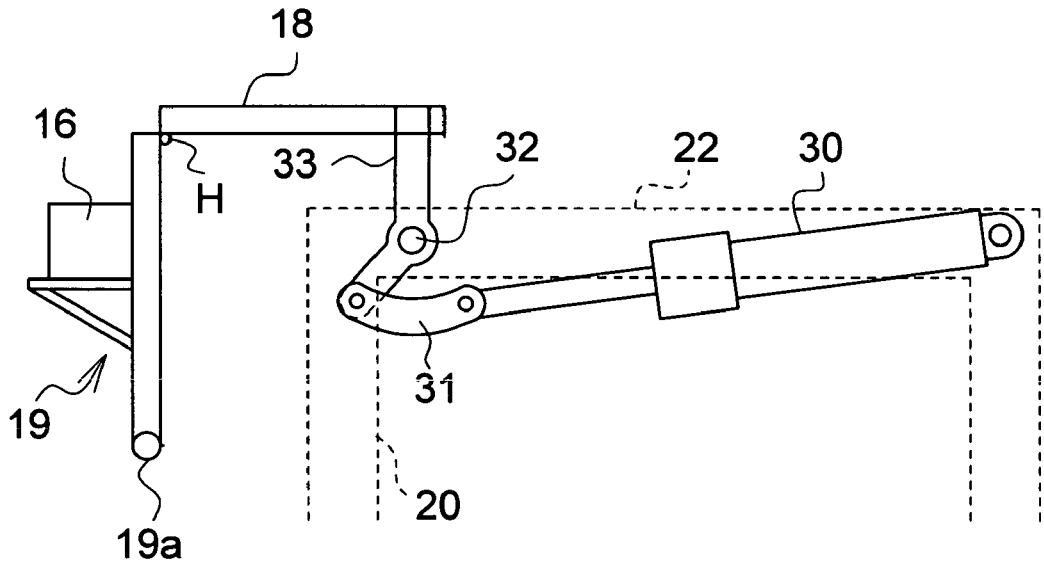
FIG. 7 is an explanatory view showing an intermediate state when the opening of the oscillating support is opened by rotating an operating plate.
Figure 8:
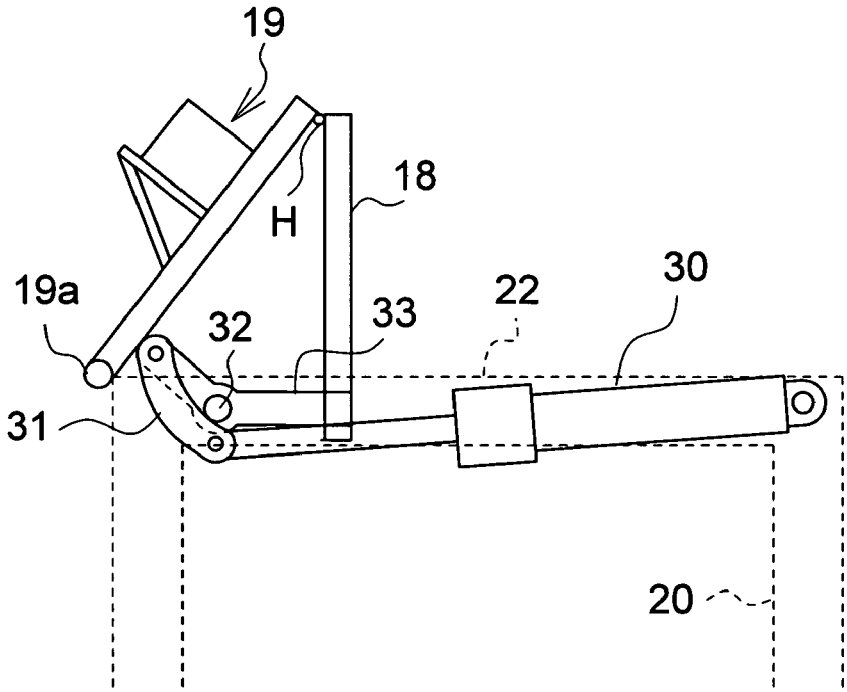
FIG. 8 is an explanatory view showing a state where the opening of the oscillating support is fully opened.

And in this preferred embodiment, as shown in FIGS. 6 to 8, the opening portion of the above oscillating support 20 is configured to be covered with an operating plate 18 and a burner holding plate 19 hinged through a hinge H below the operating plate 18 so as to be capable of being opened/closed.

Moreover, a chute plate 14 which serves as a discharge guide protrudes at a lower end of the opening.

In this embodiment, the operating plate 18 can be displaced to the opening/closing positions by expansion/contraction of a third cylinder 30.

That is, in this embodiment, the oscillating support 20 comprises a lower frame as the bottom portion 21, an upper frame 22 which is oppositely spaced from the lower frame in the upper direction, and front and rear column supports 23 and 24 which extend in the vertical direction and connect the lower frame 21 and the upper frame 22 with each other.

And the third cylinder 30 has a base end which is pivotally attached to the column 23 close to the rear side (in the front of the vehicle) so as to be expanded/contracted forward (in the rear of the vehicle) along the upper frame 22.

One end of a relay link member 31 having a substantially boomerang-like shape is pivotally attached at an end of the third cylinder 30.

On the other hand, a front side (in the rear of the vehicle) of the upper fame 22 is spanned with a shaft rod 32, and both ends of the shaft rod 32 are fixed to the right and left upper frame 22.

A middle position of an operating lever 33 having a substantial V shape is pivotally attached to this shaft rod 32, and one end of the operating lever 33 is pivotally attached to the other end of the relay link member 31.

Further, the other end of this operating lever 33 is fixed to the operating plate 18.

Thus, when the third cylinder 30 is expanded from a retired position shown in FIG. 6, the operating plate 18 rotates with the shaft rod 32 as a supporting point as shown in FIGS. 7 and 8.

A burner holding plate 19 has a burner attachment base 16 provided thereto, and is configured to emit flames toward the opening portion 9 of the heating container 3 when a burner (not shown) is attached thereto.

Even if the operating plate 18 rotates, the burner holding plate 19 maintains a suspended attitude with a hinge H as a supporting point using its own weight. When the operating plate 18 has rotated to a position which is substantially orthogonal to the upper frame 22, the burner holding plate 19 is lifted up to a full open position of the opening of the oscillating support 20.

At this time, a lower end of the burner holding plate 19 is linked with a cross bar 19*a* which is longer than the opening width, and the cross bar 19*a* guides the burner holding plate 19 so as not to move onto the oscillating support 20 at the full open position.

Furthermore, when the third cylinder 30 is contracted, the opposite operation is performed, and the operating plate 18 and the burner holding plate 19 are aligned on the same line and displaced to a closing position at which the opening of the oscillating support 20 is closed.

The movement of this third cylinder 30 may be controlled in cooperation with the movement of the first derricking cylinders 7 or the second derricking cylinders 8.

In the above preferred embodiment, the operating lever 33 is swiveled and displaced by using lever tilting means constituted of the third cylinder 30 and the relay link member 31, but the relay link member may be substituted with a chain.

Besides, the lever tilting means can be substituted with known tilting means used to tilt the operating lever 33 with the shaft rod 32 as a supporting point.

As a result, it is possible to perform interlocking in such a manner that the opening of the oscillating support is closed at the time of heating and the opening of the oscillating support is opened at the time of inputting or discharging the heating object.

Figure 12:
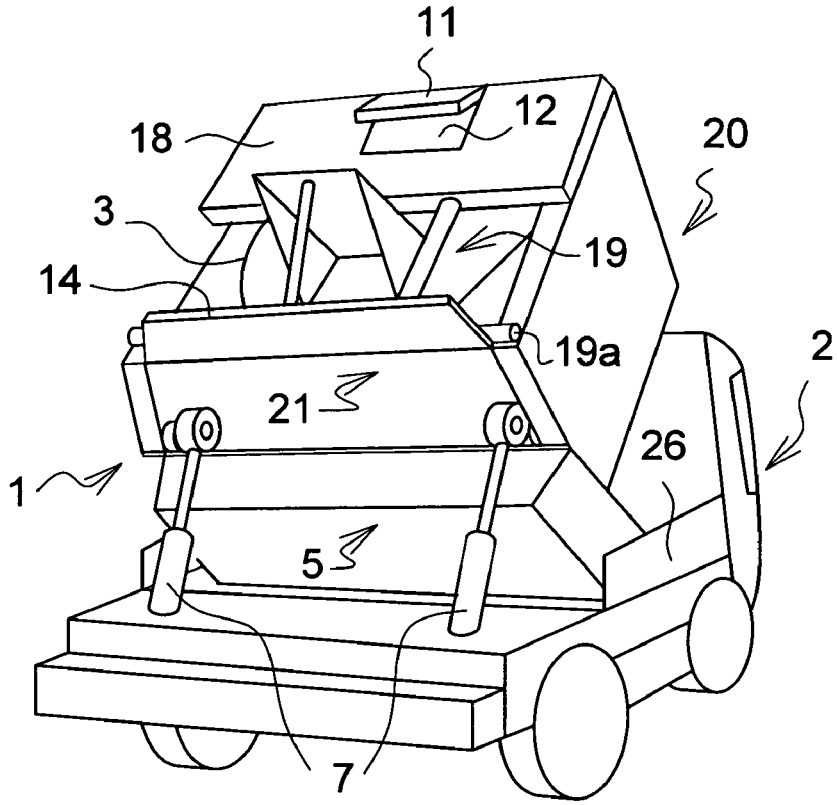
FIG. 12 is a perspective view seen from the back side of the truck in FIG. 10.

It is to be noted that a small smoke control door 11 is provided at the center of the operating plate 18 so as to be capable of being opened/closed in the drawing, and a smoke control opening 12 (See FIG. 12) can be opened by opening the door 11.

Next, a chute plate 14 is configured to protrude on the oscillating support 20 below the opening portion 9 of the heating container 3, and downwardly guides the asphalt discharged from the opening portion 9 of the heating container 3.

This chute plate 14 is pivotally attached at a lower end of a side panel of the oscillating support 20, and it may be displaced to opening/closing positions by attachment/detachment operations of hooking means or an automatic operation using a cylinder.

In a standby state shown in FIG. 1, in this tilting heating apparatus 1, the first derricking cylinders 7 are contracted while the second derricking cylinders 8 are expanded, and this tilting heating apparatus 1 takes a neutral attitude in which the heating container 3 is arranged in the horizontal direction.

Figure 9:
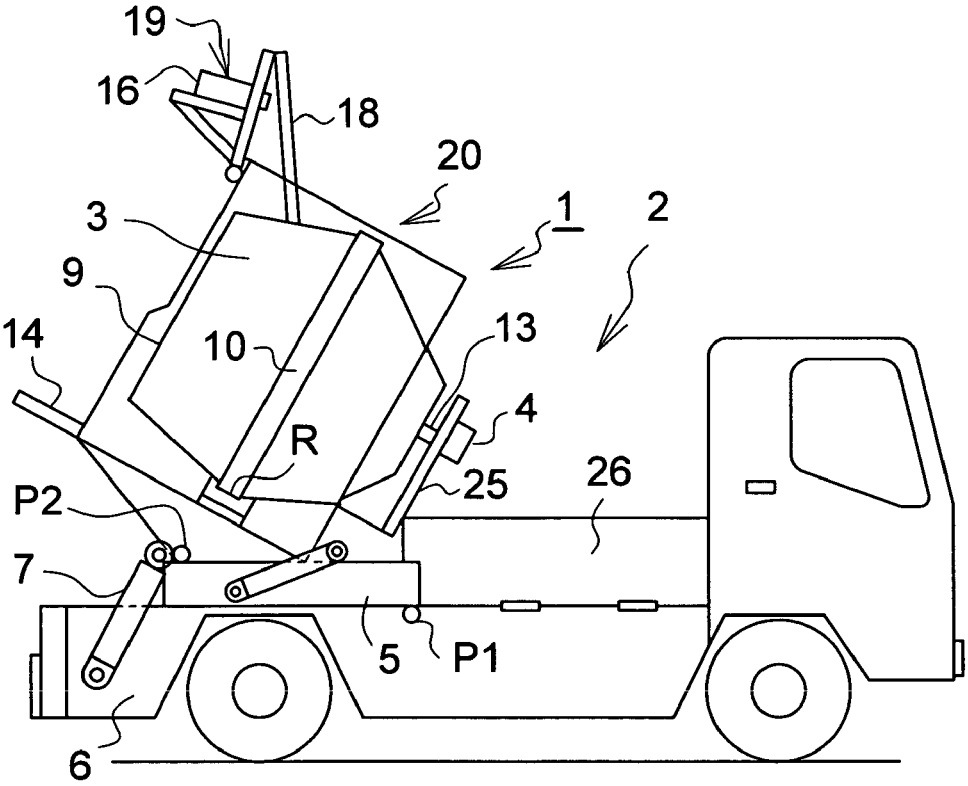
FIG. 9 is a side view of a truck showing the standard state of the tilting heating apparatus.

Next, in a standard state shown in FIGS. 2 and 9, the second derricking cylinders 8 are contracted with the first derricking cylinders 7, the opening portion 9 of the heating container 3 is caused to face slightly upward, the bottom portion of the heating container 3 is caused to face downward, and the tilting heating apparatus 1 takes a stable attitude in which the bottom portion 21 of the oscillating support 20 is hooked on the tilting base 5.

In such a standard attitude, since the gravity point of the entire vehicle 2 having the tilting heating apparatus 1 mounted therein is lowered, the stability is increased.

Figure 10:
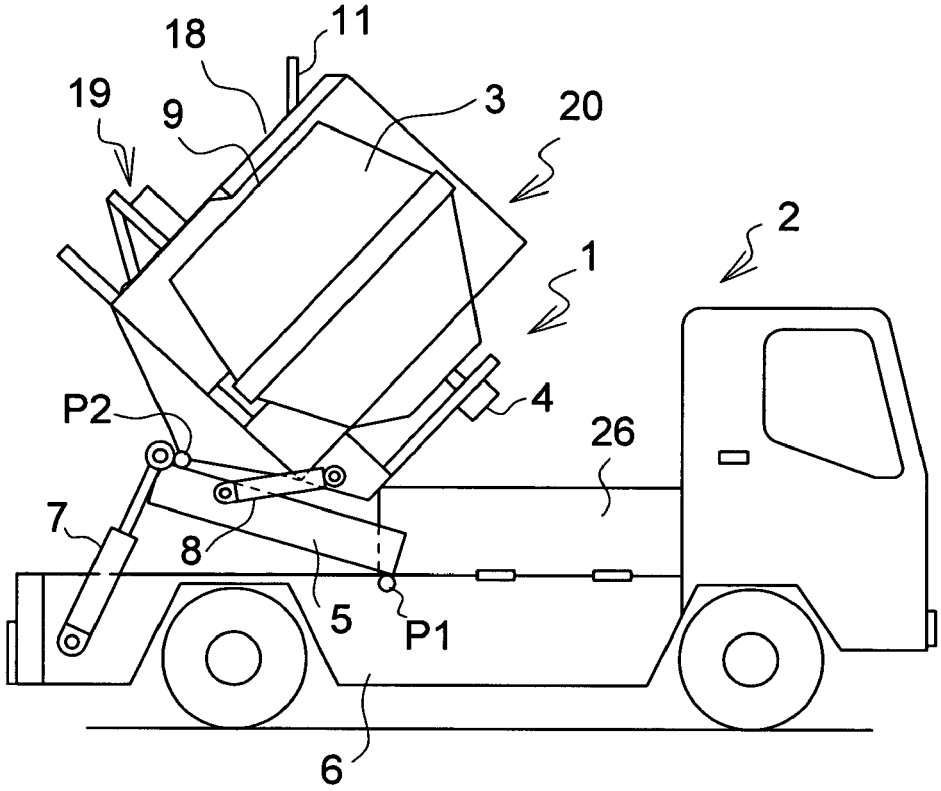
FIG. 10 is a side view of the truck showing an uppermost position state of the tilting heating apparatus.

Next, when moving the opening portion 9 of the heating container 3 to an uppermost position, the first derricking cylinders 7 are expanded and the second derricking cylinders 8 remain in the contracted state as shown in FIGS. 3 and 10.

By this, since the oscillating support 20 is tilted with a pivot shaft P as a supporting point, the heating container 3 is lifted up together with the oscillating support 20 and tilted so as to cause the opening portion 9 to further face upward.

At this time, since the opening portion 9 of the heating container 3 faces upward, an inputting operation using a bucket of a wheel loader can be facilitated.

The oscillating support 20 expands the third cylinder 30 when inputting the heating object, rotates the operating plate 18 as described above, and moves up the burner holding plate 19, thereby fully opening the opening portion.

At the time of heating, on the contrary, the oscillating support 20 contracts the third cylinder 30, rotates the operating plate 18 in the reverse direction as described above, and moves down the burner holding plate 19, thereby closing the opening portion of the oscillating support 20 so as to face it.

In this state, the drive motor 4 is rotated, flames are emitted into the heating container 3 by using the burner while rotating the heating container 3, thus heating the asphalt piece in the heating container 3.

After completion of heating, the drive motor 4 is stopped, rotation of the heating container 3 is stopped, and the first hydraulic cylinders 7 are contracted, thereby returning to the standard attitude.

Figure 11:
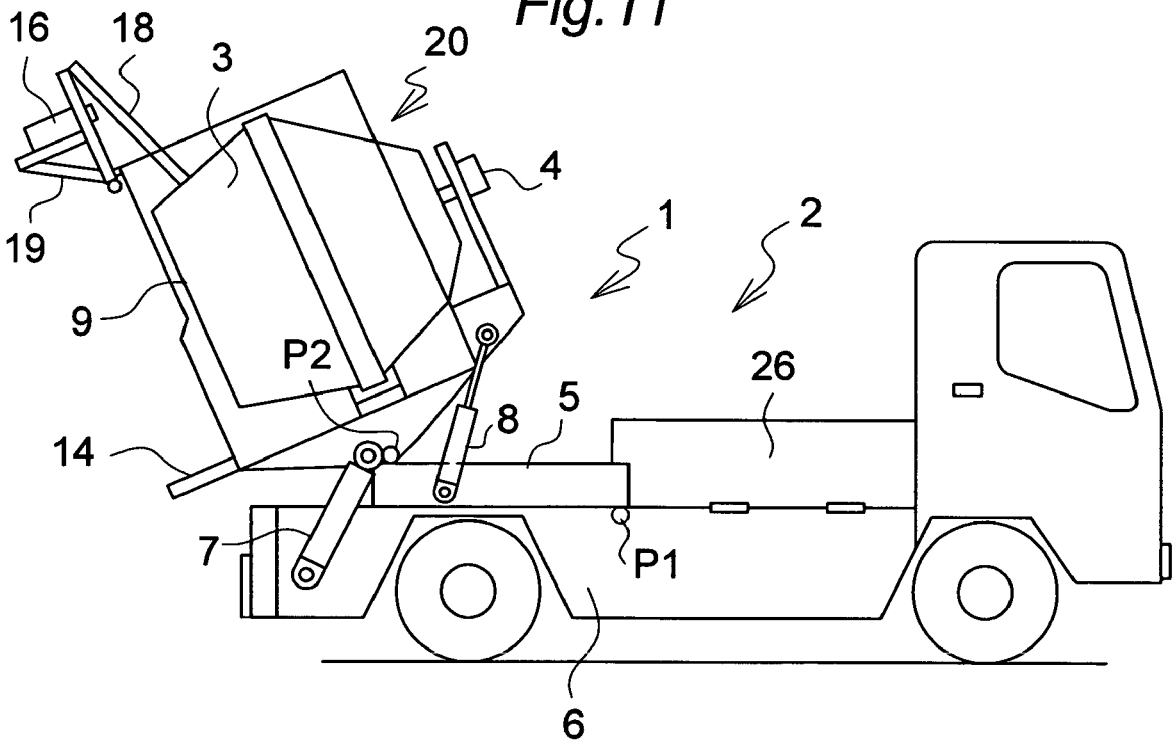
FIG. 11 is a side view of the truck showing a discharge state of the tilting heating apparatus.

Subsequently, the second derricking cylinders 8 are expanded from this standard attitude as shown in FIGS. 4 and 11, the oscillating support 20 is tilted downward to the rear side of the vehicle 2, and the opening portion 9 is displaced to a discharge state in which the opening portion 9 faces down.

Although the description has been given as to the example in which the tilting base 5 is not moved up in this embodiment, the first derricking cylinders 7 may be expanded and the tilting base 5 may be moved up in advance. Then, the second derricking cylinders 8 may be expanded and the oscillating support 20 may be tilted downward to the rear side of the vehicle 2, thereby displacing the opening portion 9 to the discharge state in which the opening portion 9 faces down.

Figure 13:
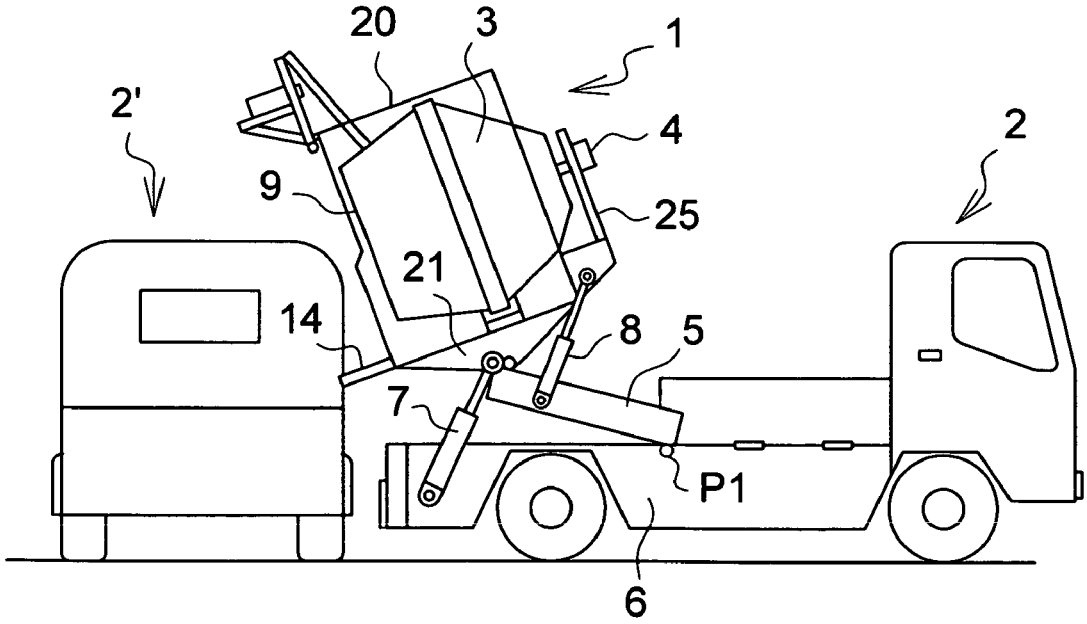
FIG. 13 is a side view showing the discharge state into a dump truck.

In this case, as shown in FIG. 13, a position of the opening portion 9 of the heating container 3 as the discharge position can be set to a higher position than that in the embodiment shown in FIGS. 4 and 11. Therefore, the heating object can be directly discharged to the bed of the vehicle 2' such as a dump truck.

It is to be noted that the third cylinder 30 is expanded, the operating plate 18 is inverted and raised in order to move up the burner holding plate 19 to the uppermost position in conjunction with the displacement of the oscillating support 20 to the discharge position, thereby fully opening the opening portion of the oscillating support 20.

Then, the recycled asphalt is discharged from the opening portion 9 of the heating container 3, guided on the chute 14 and caused to fall onto the ground or the bed. As a result, it can be used for an asphalt repair work.

Although the description has been given as to the example in which the tilting heating apparatus is mounted on the vehicle such as a truck in the foregoing embodiment, the present invention is not restricted thereto, and a structure in which the tilting heating apparatus is mounted on a non-illustrated transportable base may be adopted.

Further, a mechanism which linearly moves in an expansion/contraction direction may be used in place of all or a part of the first to third cylinders.

Furthermore, although the present invention is used for recycle of the asphalt in the embodiment, the heating object is not restricted to particular applications or types as long as it is a heating object which requires heating or combustion.

Moreover, although heating with respect to the heating object has been described in the foregoing embodiment, the present invention includes the apparatus which performs heat retention after heating.

The heat retaining means may be the same as or different from the heating means.

It is needless to say that any other design change may be made as long as the gist of the present invention is not changed.

What is claimed is:

1. A tilting heating apparatus comprising:

a tilting base which is placed on a fixed portion such as a bed of a vehicle, has a base end to be a front side of the vehicle is pivotally attached on the fixed portion and pivotal with its front end to be a rear side of the vehicle upward;

an oscillating support supported by the tilting base and whose middle position of a bottom portion is pivotally attached to the front end of the tilting base capable of pivotal movement in the fore-and-aft direction on the tilting end;

a heating apparatus consisting of a heating container attached onto the oscillating support and having a bottom with an opening and a pivotal driving mechanism for turning the heating container;

first derricking cylinders provided between the front end side of said tilting base and the fixed portion side for expansion/contraction and for displacing said tilting base to a substantially horizontal position overlapping on the fixed portion and a rearward tilting position where the opening portion of the heating container is displaced upward by the front end side of the tilting base is moved up; and second derricking cylinders provided between the tilting base and the oscillating support side for expansion/contraction and for tilting displacing said oscillating support to in the fore-and-aft direction on the tilting base and the oscillating support as a supporting point.

2. The tilting heating apparatus according to claim 1, wherein the first derricking cylinder is made into an outrigger structure, or such a structure that an outrigger is provided separately from the first derricking cylinder and fixed to the ground in use.

3. The tilting heating apparatus according to claim 1, wherein the opening portion of the heating container is opened to the rear of the vehicle, a rear end of the heating apparatus of a bottom portion of the oscillating support to be a front side of the vehicle is formed into a socket portion having a channel-like cross section, the socket portion is capable of being fitted to the tilting base when the oscillating support is tilted, and an inclination angle of the oscillating support to the rear of the heating apparatus is increased with the lower end of the socket portion as an inclined surface.

4. The tilting heating apparatus according to claim 1, wherein:

the oscillating support comprises a lower frame as the bottom portion, an upper frame which is oppositely spaced from the lower frame in the upper direction, and a pair of column supports consisting of a front and a rear frames which extend in the vertical direction and connect the lower frame and the upper frame with each other at both ends in the fore-and-aft direction of the heating apparatus;

a middle position of an operating lever is pivotally attached to a front side of an upper frame to be the front of the heating apparatus in the rear of the vehicle;

an end of the operating lever is fixed to an operating plate overlapping in front of said front frame in the front of the heating apparatus in the rear of the vehicle and having an upper portion pivotally attached;

an upper end of a burner holding plate on which a burner attachment base is provided is pivotally attached at a lower end of the operating plate, and a base end of the operating lever is connected to lever tilting means, the operating lever is swiveled by the lever tilting means with the pivotal attachment position relative to said upper frame as a supporting point, said operating plate is moved to a position to be substantially orthogonal to the upper frame above said frame, and the burner holding plate is displaced between a full open position at which it is moved up to the upper end of the front frame and a closing position at which the operating plate and the burner holding plate close to the front side of the front frame in parallel with the front frame.

5. The tilting heating apparatus according to any one of claims 1 to 4, wherein the heating apparatus is provided on a bed of a vehicle.

6. The tilting heating apparatus according to claim 1, wherein the heating apparatus heats asphalt or a paving waste material.

7. An on-the-spot heat treatment system for a heating object, in a system for heat treatment of a heating object to be offered for use, a tilting heating apparatus is so constituted that a fixed portion is provided at a predetermined position, a tilting base is formed on the fixed portion capable of tilting, an oscillating support pivotally holding a heating container with a bottom having an opening is pivotally attached onto the tilting base, the tilting base and the oscillating support are pivotally moved individually or at the same time so that the attitude of the heating container or the position of the opening is inclined and displaced in a desired direction so that input, heating, heat retention or discharge of the heating object can be carried out individually.

8. The on-the-spot heat treatment system for a heating object according to claim 7, wherein the tilting heating apparatus comprises a tilting base which is placed on a fixed portion and pivotal upward; an oscillating support supported by the tilting base and capable of pivotal movement; a heating apparatus consisting of a heating container attached onto the oscillating support and having a bottom with an opening and a pivotal driving mechanism for turning the heating container; first derricking cylinders provided between the fixed portion side and the tilting base side for expansion/contraction and for displacing the tilting base to a substantially horizontal position and a rearward tilting position where the opening of the heating container is displaced upward; and second derricking cylinders provided between the tilting base side and the oscillating support side for expansion/contraction and for displacing the oscillating support to a stationary position on the tilting base and in a forward tilting direction.

9. The on-the-spot heat treatment system for a heating object according to claim 7 or 8, wherein the heating apparatus heats asphalt or a paving waste material.

10. A tilting heating apparatus according to claim 4, wherein an operating plate suspended and covering the upper front face to be the front of the heating apparatus on the rear face of the oscillating support in the rear of the vehicle and a burner holding plate pivotally attached to a lower end of the operating plate and covering the lower front face of the oscillating support are provided;

an upper end of said operating plate is fixed to a front end of an operating lever pivotally attached to an upper portion of the oscillating support;

the operating lever is rotated to move up the operating plate to substantially orthogonal via a horizontal attitude, and the burner holding plate pivotally attached to the operating plate is raised to a full open position of the opening provided on the front face of the oscillating support to be the front of the heating container in the rear of the vehicle.

11. A tilting heating apparatus comprising:

a base pivotally attached to a base support structure;

an oscillating support that is pivotally attached to said base;

a heating container having an opening and being attached to said oscillating support so as to be operably rotatable about an axis;

at least one first actuator arranged so as to move said base between a first position and a second position; and at least one second actuator arranged so as to move said oscillating support between a first position and a second position.

12. The tilting heating apparatus according to claim 11, wherein said first actuator is at least one of pneumatic and hydraulic and said second actuator is at least one of pneumatic and hydraulic.

13. The tilting heating apparatus according to claim 11, wherein said heating container is mechanically rotatable.

14. The tilting heating apparatus according to claim 11, wherein said titling heating apparatus heats at least one of asphalt and paving waste material.

15. The tilting heating apparatus according to claim 11, wherein said base support structure comprises an outrigger structure.

16. The tilting heating apparatus according to claim 11, wherein said base support structure comprises a vehicle.

17. The tilting heating apparatus according to claim 11, wherein said oscillating support is capable of interfacing with said base when said oscillating support is in a tilted position.

18. The tilting heating apparatus according to claim 11, wherein:

a frame is attached to said oscillating support;

an operating lever is connected to said frame;

an end of said operating lever is fixed to an operating plate;

a burner holding plate is pivotally attached to said operating plate, and said operating lever is capable of moving said operating plate.

19. A tilting heating apparatus according to claim 18, wherein said operating lever is connected to said frame via a lever actuating mechanism.

20. A tilting heating apparatus comprising:

a base pivotally attached to a base support structure;

an oscillating support that is pivotally attached to said base;

a heating container having an opening and being attached to said oscillating support so as to be operably rotatable about an axis;

at least one first actuator comprising a first fixed end and a first expandable end, wherein said first fixed end is attached to said base support structure and said first expandable end is attached to said base and said first actuator is capable of moving said base between a first position and a second position; and at least one second actuator comprising a second fixed end and a second expandable end, wherein said second fixed end is attached to said base and said second expandable end is attached to said oscillating support and said second actuator is capable of moving said oscillating support between a first position and a second position.

* * * * *